US012601577B1

(12) United States Patent
Miska et al.

(10) Patent No.: US 12,601,577 B1
(45) Date of Patent: Apr. 14, 2026

(54) QUICK DISCONNECT COUPLER FOR ROCKET MOTOR

(71) Applicant: BAE Systems Information and Electronic Systems Integration Inc., Nashua, NH (US)

(72) Inventors: Jacob W. Miska, Nashua, NH (US); Jason H. Batchelder, Nashua, NH (US); Matthew F. Chrobak, Groton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 19/045,917

(22) Filed: Feb. 5, 2025

(51) Int. Cl.
*F42B 15/36* (2006.01)

(52) U.S. Cl.
CPC ..... *F42B 15/36* (2013.01)

(58) Field of Classification Search
CPC ..... F42B 15/36
USPC ..... 102/377
See application file for complete search history.

(56) References Cited

U.S. PATENT DOCUMENTS 4,964,339 A 10/1990 Bastian et al.
5,067,386 A 11/1991 Shioviz et al.
5,115,709 A 5/1992 Steele
5,238,209 A 8/1993 Hornyak
5,248,233 A * 9/1993 Webster ..... F16B 5/0208 102/377
5,253,587 A 10/1993 Thouron et al.
5,318,255 A * 6/1994 Facciano ..... F42B 15/36 102/378
5,370,343 A 12/1994 Hornyak
5,400,713 A 3/1995 Humiston et al.
5,641,123 A 6/1997 Kishimoto et al.
6,568,330 B1 5/2003 Kaiserman et al.
6,640,720 B1 11/2003 Biserod
6,761,330 B1 7/2004 Bittle et al.
6,928,931 B1 8/2005 Biserod
7,748,663 B1 * 7/2010 Craig ..... F42B 15/36 102/377

(Continued)

FOREIGN PATENT DOCUMENTS

GB 0982440 A 2/1965
WO WO1998019127 A1 5/1998
WO WO2019190658 A1 10/2019

*Primary Examiner* — Bret Hayes
(74) *Attorney, Agent, or Firm* — Scott J. Asmus

(57) ABSTRACT

A system for coupling sections of a platform. In an example, the coupler system includes a cylindrical housing to be attached to a first section; a spin member within the housing configured to rotate about a longitudinal platform axis; a groove pattern etched into the spin member; a plunger, within the spin member, configured to move linearly along the longitudinal axis; a first spring configured to cause the linear plunger movement in response to acceleration of the platform; a guide pin attached to the plunger, extending radially outward toward the housing, configured to travel along the groove pattern with plunger movement; a ball coupler mechanism to provide mechanical attachment of the coupler system to a second section; and a second spring configured to rotate the spin member, such that movement of the plunger and rotation of the spinner cause the ball coupler mechanism to disengage from the second section.

20 Claims, 14 Drawing Sheets

(56) References Cited

U.S. PATENT DOCUMENTS

| | | | | |
|---|---|---|---|---|
| 7,800,032 | B1 | 9/2010 | Facciano et al. | |
| 9,151,579 | B2 | 10/2015 | Martineau et al. | |
| 10,094,646 | B2 | 10/2018 | Albright et al. | |
| 10,377,510 | B1 | 8/2019 | Riskas et al. | |
| 2004/0216634 | A1* | 11/2004 | Cleveland | B64G 1/645 102/378 |
| 2006/0278754 | A1 | 12/2006 | Sankovic et al. | |
| 2017/0153097 | A1* | 6/2017 | Kahana | F42B 15/36 |
| 2018/0023933 | A1* | 1/2018 | Reimann | F42B 15/36 102/378 |

* cited by examiner

QUICK DISCONNECT COUPLER FOR ROCKET MOTOR

FIELD OF DISCLOSURE

The present disclosure relates to coupling of aeronautical platform sections, and more particularly to a quick disconnect coupler for a rocket motor.

BACKGROUND

Many aeronautical platforms, such as missiles, are made up of multiple sections. For example, a missile may comprise a rocket motor section and a payload section. The rocket motor section provides a source of propulsion at launch. After some period of time, however, the fuel in the rocket motor is expended and the rocket motor section becomes a source of undesired weight and aerodynamic drag which limits the range and maneuverability of the missile.

Figure 1A:
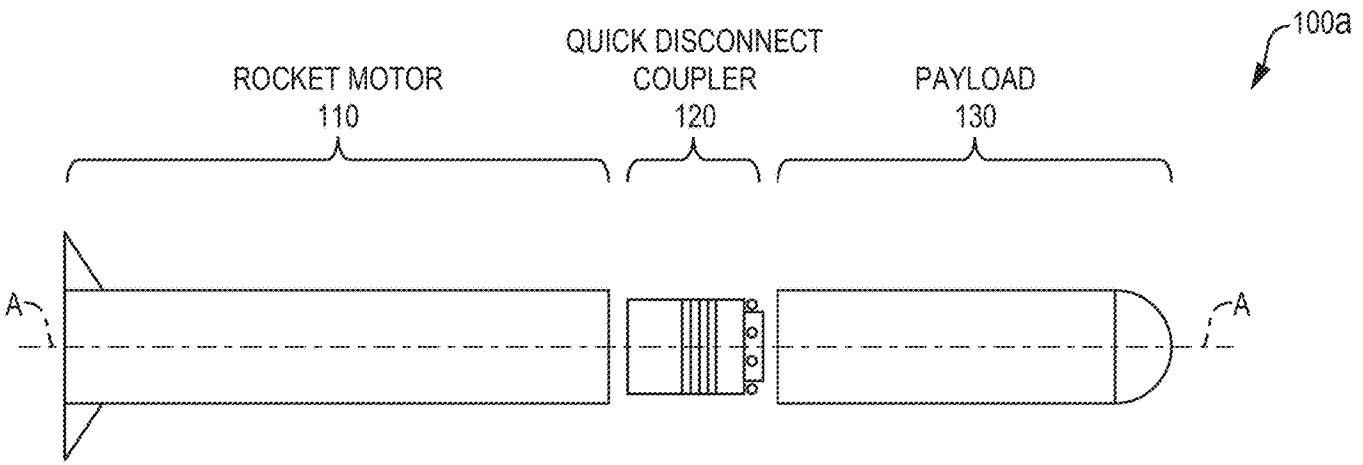
FIG. 1A illustrates sections of an aeronautical platform, including a quick disconnect coupler, configured in accordance with certain embodiments of the present disclosure.

Although the following Detailed Description will proceed with reference being made to illustrative embodiments, many alternatives, modifications, and variations thereof will be apparent in light of this disclosure.

DETAILED DESCRIPTION

Techniques are described herein for a quick disconnect coupler for sections of an aeronautical platform. As noted above, many aeronautical platforms, such as missiles, precision guided munitions, artillery rockets and precision guided bombs are made up of sections. For example, a missile may comprise a rocket motor section and a payload section. The rocket motor section provides a source of propulsion at launch. After the fuel in the rocket motor is expended, however, the rocket motor section becomes a source of undesired weight and aerodynamic drag which limits the range and maneuverability of the missile. This issue can be amplified as the rocket motor section may be longer than the payload section. To this end, and in accordance with an embodiment of the present disclosure, a quick disconnect coupler is provided which allows the rocket motor section to disconnect from the remaining section of the missile, while in flight, after the rocket has completed the function of providing thrust. The quick disconnect coupler employs a mass, spring, and damper system to initiate a sequence of mechanical reactions in response to the high acceleration conditions associated with launch. The mass, spring, and damper system guides the progress of a spring loaded rotator that unlocks a ball coupler mechanism and an ejector plate to cause the two sections (e.g., rocket motor and payload) to push away from each other.

In accordance with an embodiment, a coupling system implementing the techniques for quick disconnect coupling includes a cylindrical housing configured to be fixedly attached to the first section (e.g., the rocket motor) and a spin member disposed within the housing and configured to rotate about a longitudinal axis of the platform. The coupling system also includes a groove pattern etched into the spin member, a plunger disposed within the spin member and configured to move linearly along the longitudinal axis, and a first spring configured to cause the linear movement of the plunger in response to acceleration of the platform. The coupling system further includes a guide pin attached to the plunger which extends radially outward toward the housing and is configured to travel along the groove pattern as the plunger moves. The coupling system further includes a ball coupler mechanism configured to provide mechanical attachment of the coupler system to the second section (e.g., the payload) and a second spring configured to rotate the spin member, such that a combination of the movement of the plunger and the rotation of the spinner cause the ball coupler mechanism to disengage from the second section. The coupling system further includes a circular plate disposed at a forward end of the coupler system (e.g., the end closest to the second section) and a third spring configured to eject the circular plate, in response to the combination of the movement of the plunger and the rotation of the spinner, such that the second section is ejected from the coupler system. The system further includes a damper disposed within the plunger and configured to resist linear movement of the plunger in response to forces less than the platform launch forces and aerodynamic drag forces.

It will be appreciated that the techniques described herein may provide improved performance of an aeronautical platform by increasing the flight distance and precision for many types of missiles or other projectiles, including long range and gliding missiles, compared to platforms that allows the rocket motor section to remain attached throughout the flight. Additionally, the disclosed techniques do not rely on electrical systems or controlled explosives which can increase cost and introduce reliability issues. Numerous embodiments and applications will be apparent in light of this disclosure.

System Architecture

FIG. 1A illustrates sections of an aeronautical platform 100*a*, including a quick disconnect coupler 120, configured in accordance with certain embodiments of the present disclosure. The aeronautical platform in one example includes precision guided munitions such as guided missiles, rockets, and bombs. Other examples include unguided rockets, missiles and bombs. Both scenarios can benefit from an extended range by discarding the rocket section. In this example, the aeronautical platform 100*a* is a missile comprising two stages: a rocket motor 110 and a payload section 130 coupled together by a quick disconnect coupler system 120. Such a completed configuration may also be referred to as an all-up-round missile. A longitudinal axis of the platform (A-A) is shown for reference. In other examples, different stages or sections may be included. For example, there may be multiple rocket motors stages which fire in sequence and may optionally be coupled by the disclosed quick disconnect couplers. Generally, each of the stages/sections has a cylindrical or tubular cross-section, not counting any flight control surfaces. As shown, the various stages can be coupled together so as to provide an aeronautical platform or housing having a cylindrical profile to facilitate flight, and further allow various componentry (e.g., electronics and payload materials) to be configured within one or more voids within the platform.

In some embodiments, the payload section may include one or more of a guidance circuit module, sensors (e.g., on the wings or the nose), seeker circuit module, and a warhead. In one example, the payload section 130 includes wings 170, which may be fixed or deployable, to guide the payload along the flight path to a chosen destination. In some embodiments, the rocket motor 110 is configured to provide thrust to the missile to accelerate the missile and maintain a suitable velocity to the chosen destination, for example the destination determined by a seeker circuit module. In one example, the rocket motor 110 includes fixed fins 160 to provide flight stability while the rocket motor is attached.

Figure 1B:
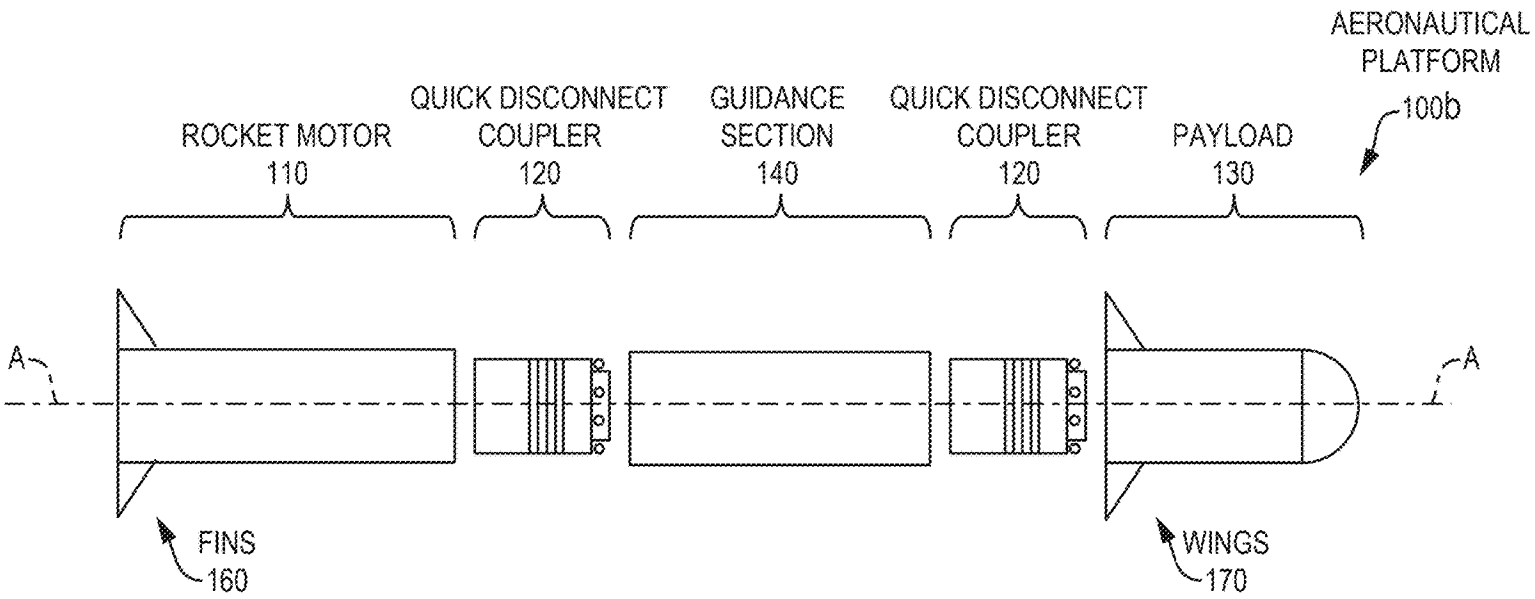
FIG. 1B illustrates sections of another aeronautical platform, including quick disconnect couplers, configured in accordance with certain embodiments of the present disclosure.

FIG. 1B illustrates sections of another aeronautical platform 100*b*, including quick disconnect couplers 120, configured in accordance with certain embodiments of the present disclosure. In this embodiment, the aeronautical platform 100*b* comprises three sections where the guidance circuits and controls are included in a separate guidance section 140 which is located between the rocket motor 110 and the payload and connected to these adjacent sections by quick disconnect couplers 120. In another example, the guidance section 140 may be coupled to the rocket motor 110 using a quick disconnect coupler 120 and coupled to the payload section 130 in a fixed manner using screw in threading (e.g., forming one integral unit comprising a guidance section and warhead). In yet another example, the guidance section 140 may be coupled to the payload section 130 using a quick disconnect coupler 120 and coupled to the rocket motor 110 in a fixed manner using screw in threading.

Figure 2:
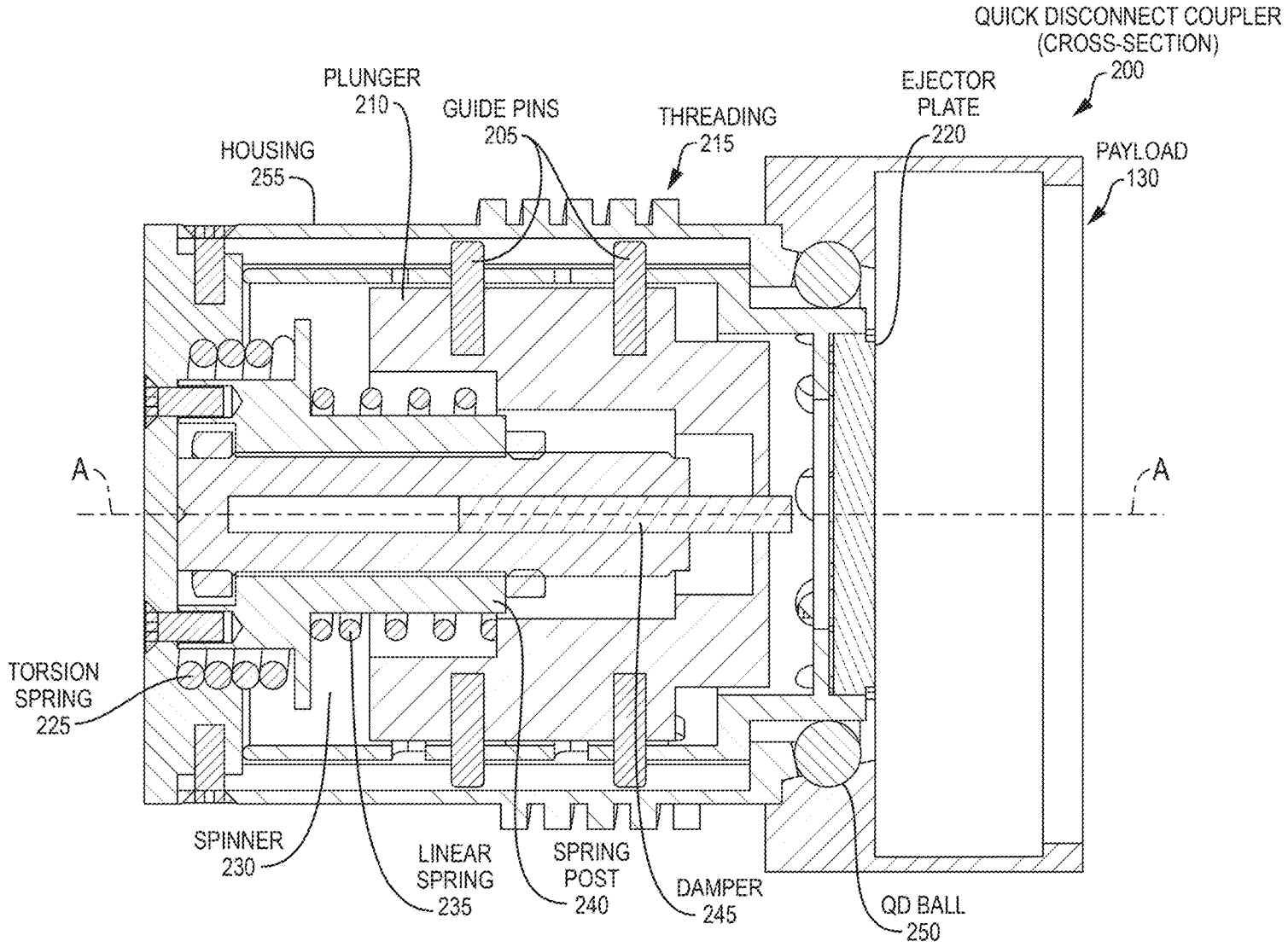
FIG. 2 provides a cross-section view of the quick disconnect coupler of FIGS. 1A and 1B, configured in accordance with certain embodiments of the present disclosure.

FIG. 2 provides a cross-section view 200 of the quick disconnect coupler 120 of FIGS. 1A and 1B, configured in accordance with certain embodiments of the present disclosure. The quick disconnect coupler 120 is shown to include a housing 255 with exterior threading 215, a plunger 210 with guide pins 205, an ejector plate 220, quick disconnect (QD) balls 250, a damper 245, a linear spring 235, a spring post 240, a spin member (or spinner) 230, and a torsion spring 225.

The housing 255 is a cylindrical shell that encloses the coupler mechanisms and provides a method for attaching the coupler, in a fixed manner, to the first (or aft) section of the platform (e.g., the rocket motor 110). In some embodiments, for example, the housing 225 has threading 215 disposed on the exterior. The exterior threading 215 is configured to couple to a threaded interface of the first section to fixedly attach the coupler to the first section 110. Said differently, the coupler 120 can be screwed into receiving threads of the first section 110 during platform assembly and remain attached to the first section after the rocket burns out and disconnects from the second section (e.g., the payload 130).

The spinner 230 is disposed within the housing 225 and configured to rotate about the longitudinal axis (A-A) of the platform. A groove pattern 310 is etched into the spinner which is described and illustrated in FIG. 3 below.

The plunger 210 is disposed within the spinner 230 and configured to move linearly along the longitudinal axis.

The damper 245 is disposed within the plunger 210 and configured to resist linear movement of the plunger in response to forces less than the platform launch forces and aerodynamic drag forces. In other words, the damper 245 serves to prevent the sequence of actions that result in disconnection from being initiated due to relatively small accelerations and decelerations of the platform that may occur prior to launch.

The linear spring 235 is configured to cause the linear movement of the plunger 210, along the longitudinal axis, in response to acceleration and deceleration of the platform. The spring post 240 is configured to hold the linear spring 235 in place as it compresses and expands.

The guide pins 205 are attached to the plunger 210 such that they extend radially outward toward the housing 255 and are configured to travel along the groove pattern 310 with the linear movement of the plunger, as will be explained in greater detail below.

The QD balls 250 function as a spherical coupler mechanism and are configured to provide mechanical attachment of the coupler system to the second section of the platform (e.g., the payload 130).

The torsion spring 225 is configured to rotate the spinner 230, such that a combination of the linear movement of the plunger 210 and the rotation of the spinner 230 cause the QD balls 250 to disengage from the second section 130, as will be described in greater detail below.

The ejector plate 220 is disposed at the forward end of the coupler system (e.g., the end closest to the second section 130) and functions in combination with the wave spring 320, illustrated and described below in FIG. 3, to eject the second section from the coupler system.

Figure 3A:
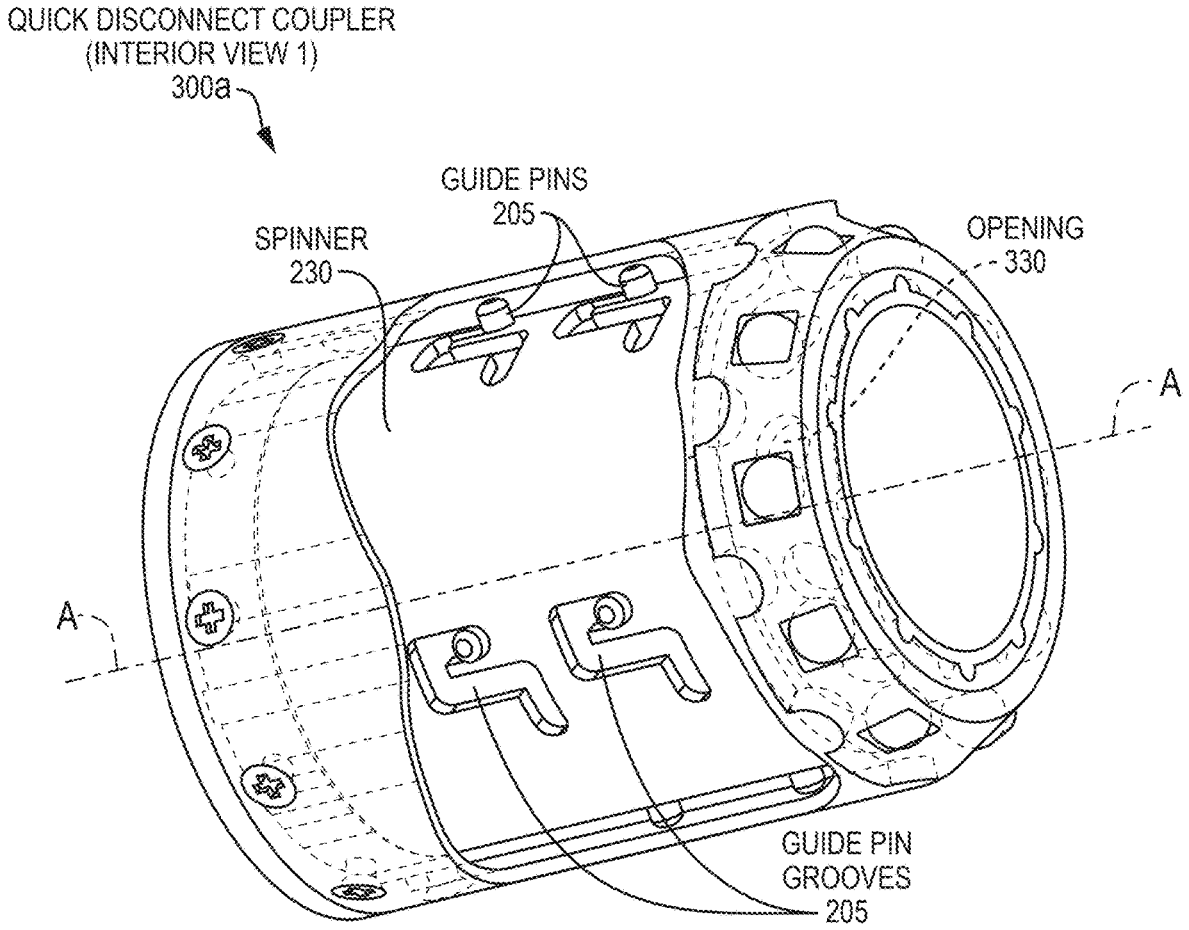
FIGS. 3A, 3B, and 3C provide perspective views of the interior of the quick disconnect coupler of FIGS. 1A and 1B, configured in accordance with certain embodiments of the present disclosure.
Figure 3B:
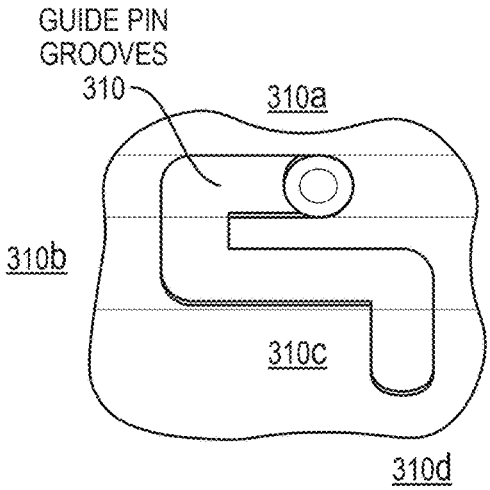
Figure 3C:
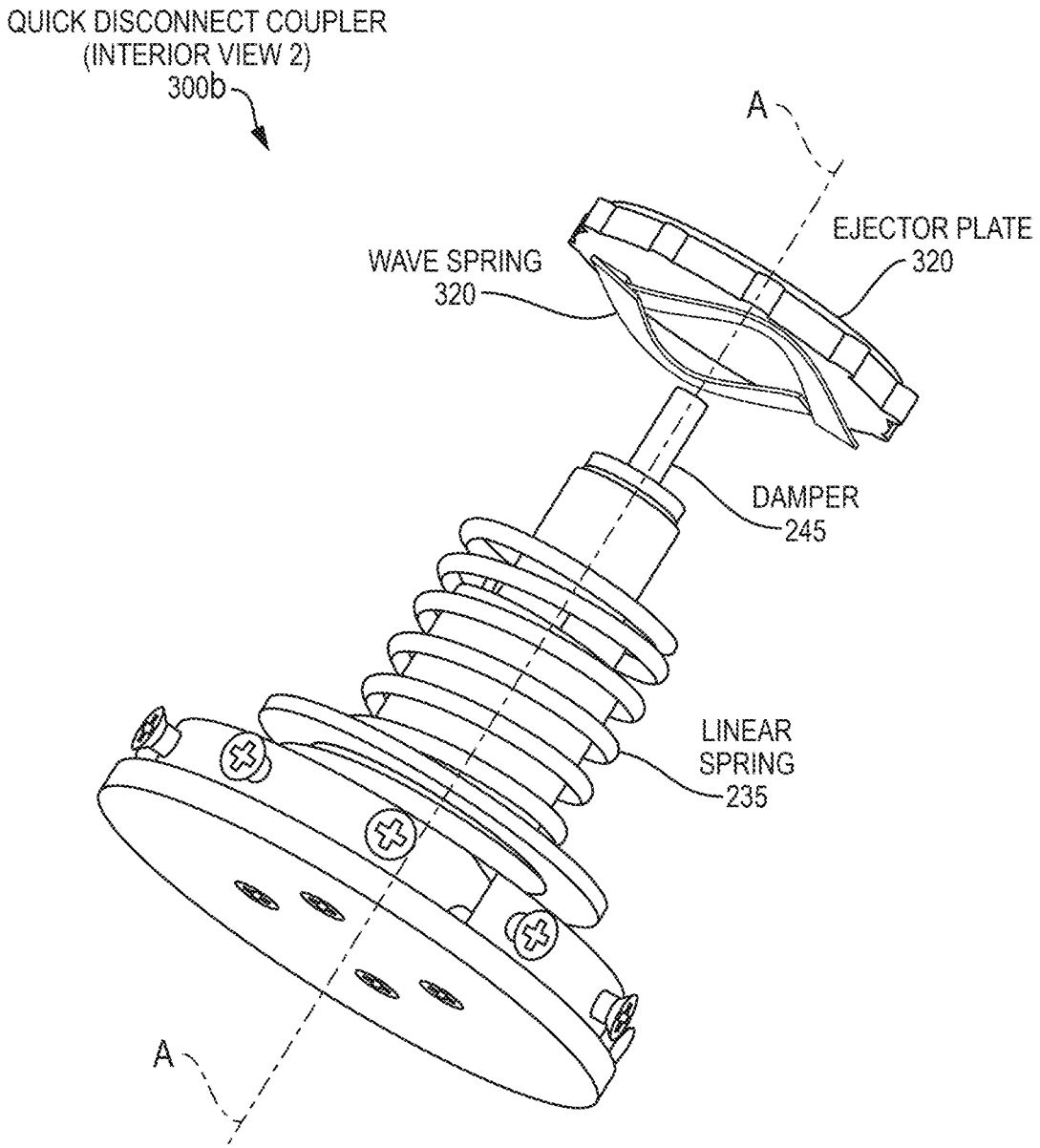

FIGS. 3A, 3B, and 3C provide perspective views 300 of the interior of the quick disconnect coupler 120 of FIGS. 1A and 1B, configured in accordance with certain embodiments of the present disclosure.

The first interior view 300*a* shows the spinner 230 (which is located under the housing 255 which is transparent in this figure) and the guide pin grooves 310 which are etched into the spinner. The guide pins are also shown to extend up from the plunger 210 through the grooves 310.

As shown, the guide pin grooves 310 follow a pattern comprising four path sections 310*a*, 310*b*, 310*c*, and 310*d*. The first path 310*a* extends in a direction parallel to the longitudinal axis. The second path 310*b* connects the aft end of the first path 310*a* to the aft end of the third path 310*c*. The third path 310*c* runs parallel to and offset from the first path 310*a*. The fourth path 310*d* extends from the forward end of the third path 310*c* in a perpendicular direction away from the first path 310*a*.

In some embodiments, there are four sets of two grooves and associated two pins. The sets may be located at 90 degree intervals around the circumference of the spinner.

Openings 330 are also shown which are configured to provide space into which the QD balls 250 can move during the final phase of the disconnect process, as will be described below.

The second interior view 300*b* provides a deeper view into the coupler 120 showing the linear spring 235, the damper 245, the wave spring 320, and the ejector plate 220. The functions of these components will also be described in greater detail below in conjunction with an explanation of the operation of the coupler.

Figure 4:
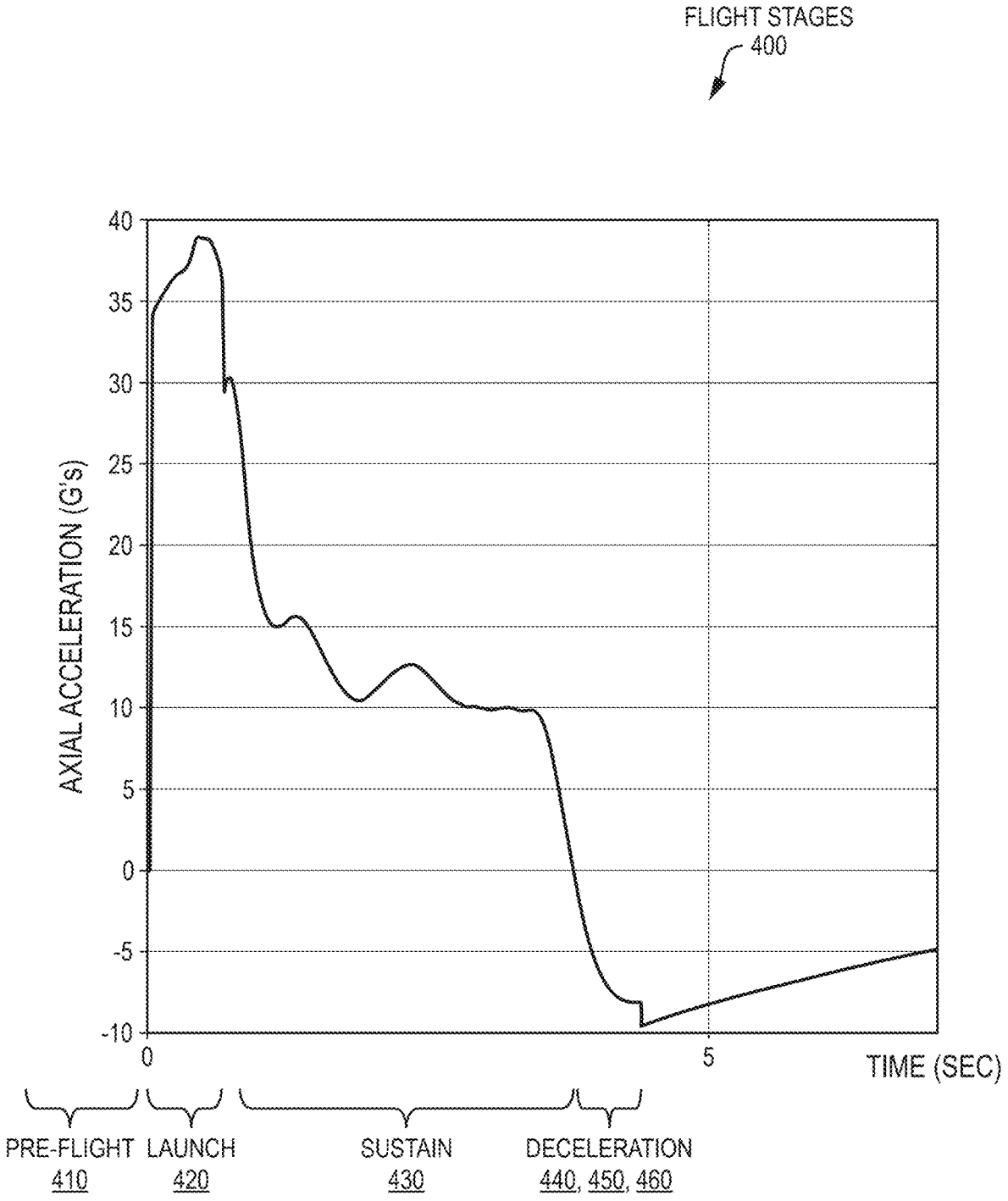
FIG. 4 illustrates flight stages of the aeronautical platform as a function of time, in accordance with certain embodiments of the present disclosure.

FIG. 4 illustrates flight stages 400 of the aeronautical platform 100 as a function of time, in accordance with certain embodiments of the present disclosure. The operation of the quick disconnect coupler 120, and the components within, will be described at a sequence of points in time that are associated with the stages of flight of the missile. For example, the pre-flight stage 410 represents the time period prior to launch, during which the coupler 120 is in a relatively static final assembled configuration and is functioning to couple the first and second sections of the platform together (e.g., joining the rocket motor 110 and payload 130).

At time t=0 seconds, the launch stage 420 begins. This stage is characterized by a rapid transition to a state of relatively high acceleration (e.g., 35 to 40 G's of acceleration) which is imparted by the force of the rocket motor as the motor burns through a supply of fuel.

A sustain stage 430 follows, during which the increased aerodynamic drag (caused by the high velocity achieved during the launch stage acceleration) counters the continuing force of the rocket motor, causing the acceleration to drop off to a lower value (e.g., 10 G's).

After the fuel supply is exhausted (e.g., the rocket motor burns out), a deceleration stage begins during which the aerodynamic drag, which is no longer countered by the rocket motor force, causes rapid deceleration down to zero G's and below. The labeling of the deceleration stage is shown to indicate that the deceleration stage comprises three parts or sub-stages 440, 450, and 460. Each of these parts correspond to different points in the explanation of the operation of the quick disconnect coupler 120 as disclosed below.

FIGS. 5 through 12 illustrate the sequence of operations that occur during the quick disconnect process and the associate dynamics of the components of the coupler 120 during that process.

Figure 5A:
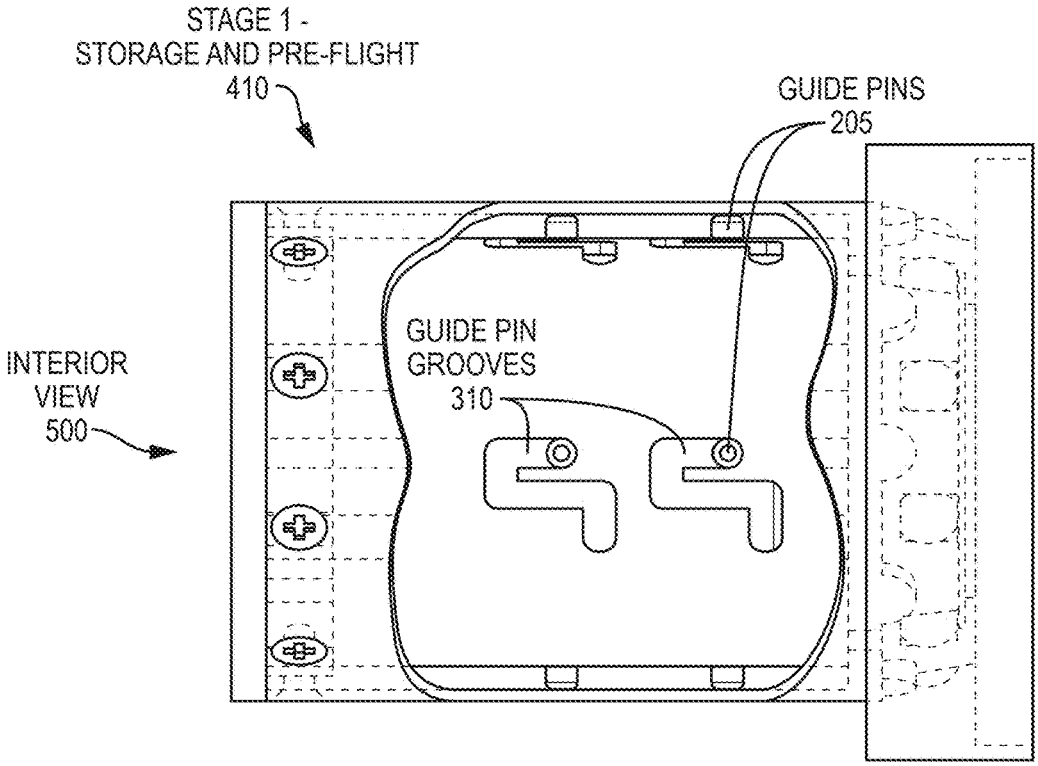
FIGS. 5A and 5B provide an interior and a cross-section view of the quick disconnect coupler of FIGS. 1A and 1B, at a pre-flight stage, configured in accordance with certain embodiments of the present disclosure.
Figure 5B:
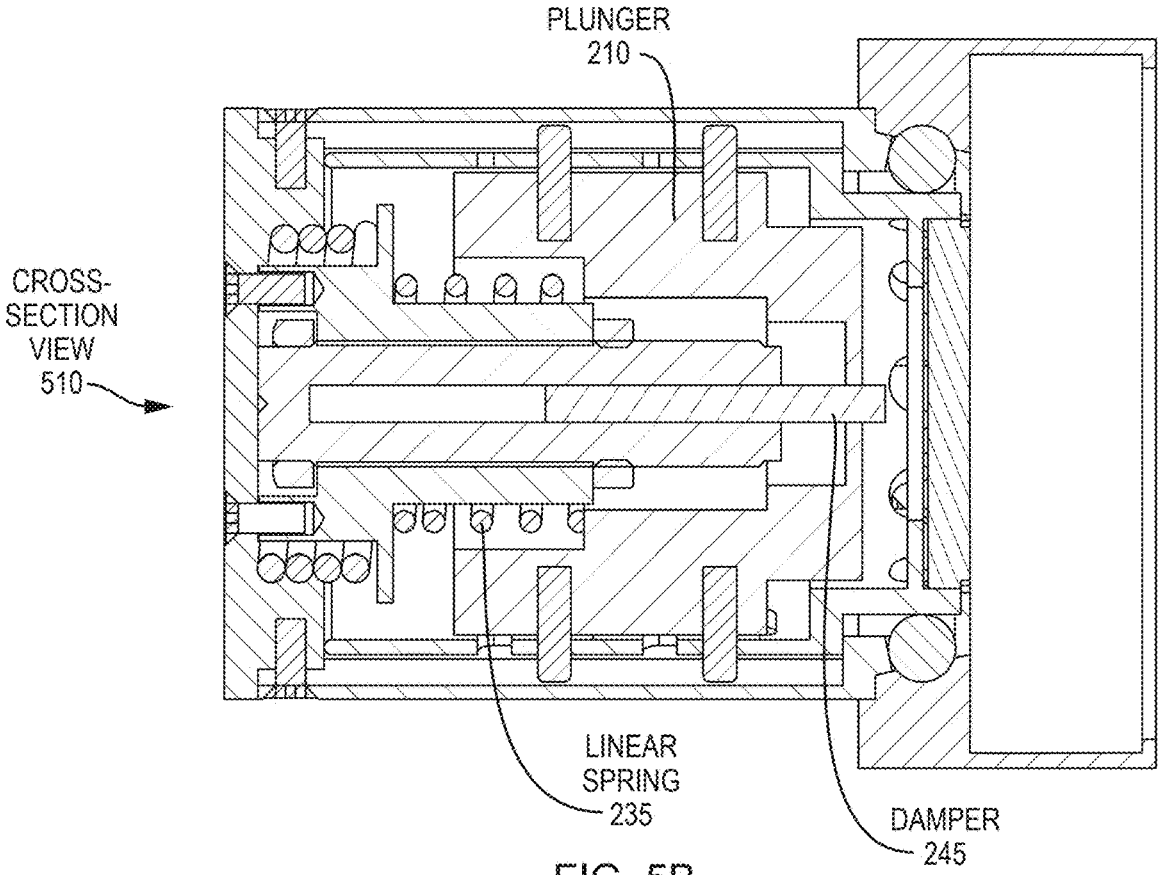

FIGS. 5A and 5B provide an interior view 500 and a cross-section view 510 of the quick disconnect coupler 120 of FIGS. 1A and 1B, at the pre-flight stage 410, configured in accordance with certain embodiments of the present disclosure. The interior view 500 illustrates that, at the pre-flight stage 410, the guide pins 205 are positioned at the forward end of the first path 310*a* of the guide pin grooves 310. The cross-section view 510 illustrates that the plunger 210 is held in place by the force of the linear spring 235. The damper 245 provides additional holding force to prevent small shocks or drops from setting off the quick disconnect mechanisms.

Figure 6A:
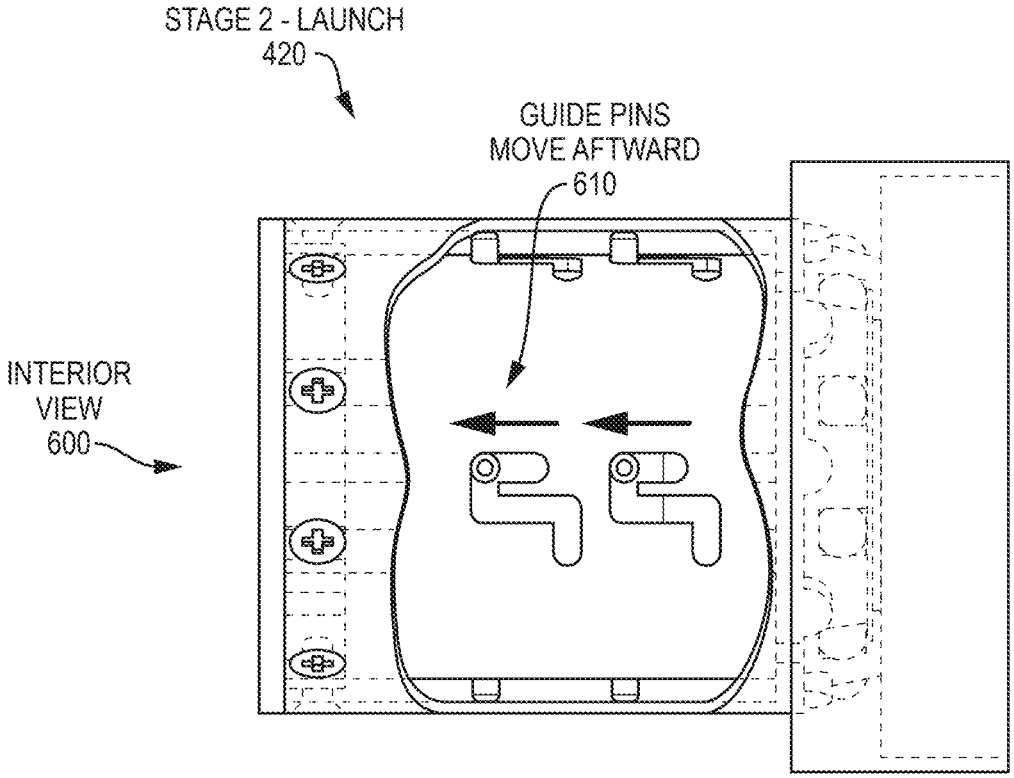
FIGS. 6A and 6B provide an interior and a cross-section view of the quick disconnect coupler of FIGS. 1A and 1B, at a launch stage, configured in accordance with certain embodiments of the present disclosure.
Figure 6B:
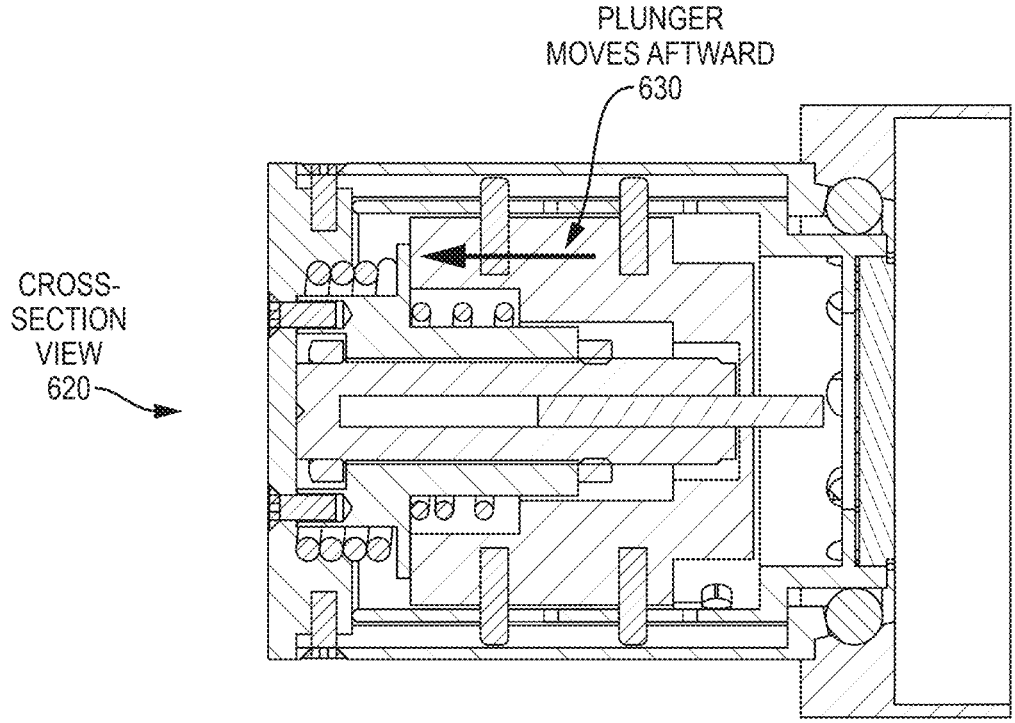

FIGS. 6A and 6B provide an interior view 600 and a cross-section view 620 of the quick disconnect coupler 120 of FIGS. 1A and 1B, at the launch stage 420, configured in accordance with certain embodiments of the present disclosure. During the launch stage, the weight of the plunger 210 combined with the sustained acceleration of the launch overcome the force of the linear spring 235 and damper 245 causing the guide pins 205 and the plunger 210 to move aftward. The interior view 600 shows the guide pins moving aftward 610 in the first path 310*a* of the guide pin grooves. The cross-section view 620 shows the aftward motion 630 of the plunger 210.

Figure 7A:
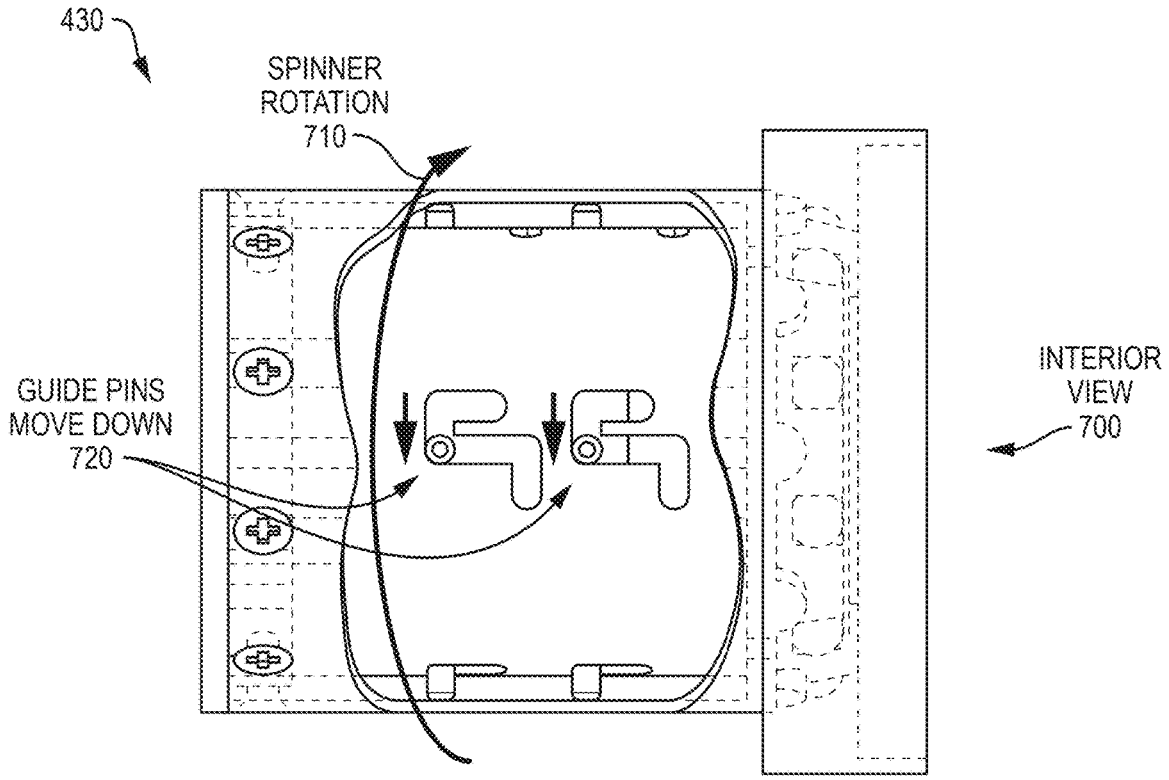
FIGS. 7A and 7B provide an interior and a cross-section view of the quick disconnect coupler of FIGS. 1A and 1B, at a sustain stage, configured in accordance with certain embodiments of the present disclosure.
Figure 7B:
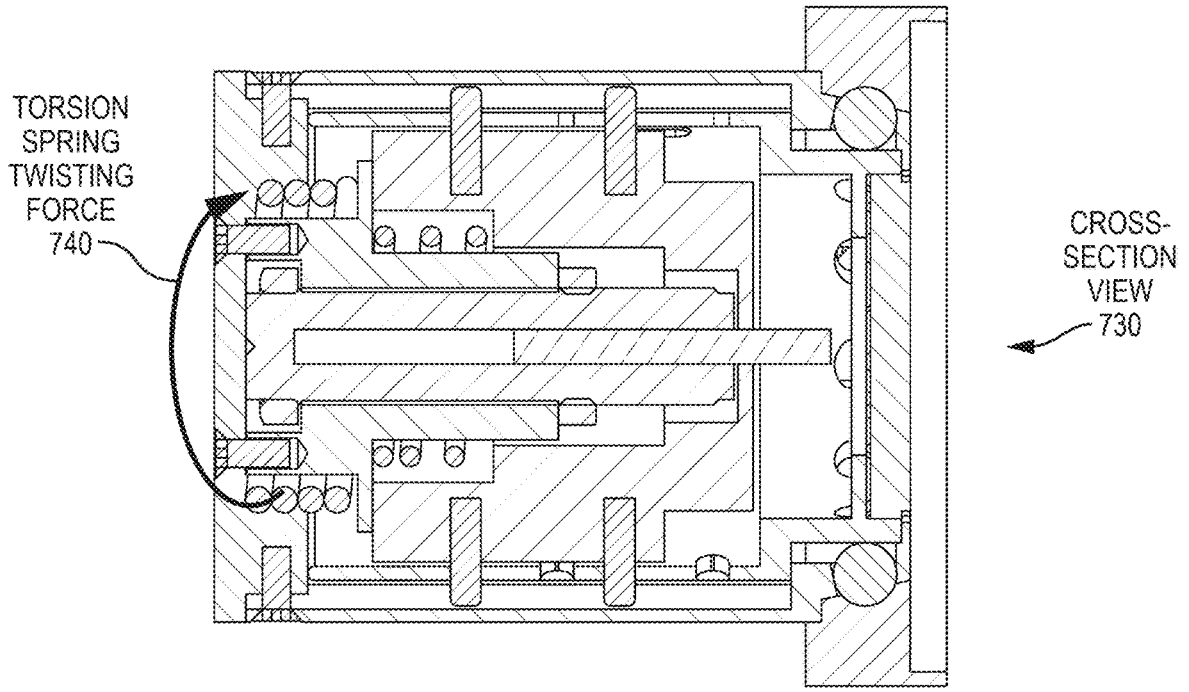

FIGS. 7A and 7B provide an interior view 700 and a cross-section view 730 of the quick disconnect coupler 120 of FIGS. 1A and 1B, at the sustain stage 430, configured in accordance with certain embodiments of the present disclosure. As shown in the interior view 700, during the sustain stage, as the plunger reaches the aft end of the first path 310*a*, the torsion spring 225 is able to rotate 710 the position of the spinner 230 causing the guide pins to move down 720 through path 310*b* of the guide pin grooves. The cross-section view 730 illustrates the torsion spring twisting force 740 which causes the spinner to rotate.

Figure 8A:
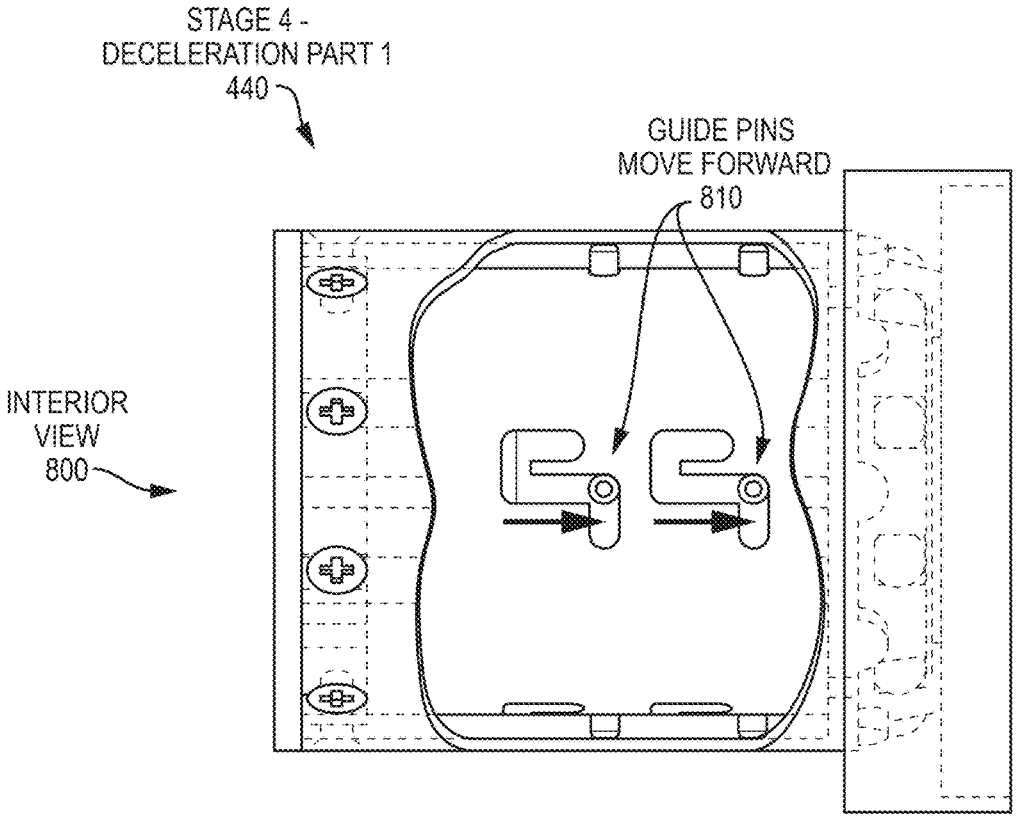
FIGS. 8A and 8B provide an interior and a cross-section view of the quick disconnect coupler of FIGS. 1A and 1B, at a first deceleration stage, configured in accordance with certain embodiments of the present disclosure.
Figure 8B:
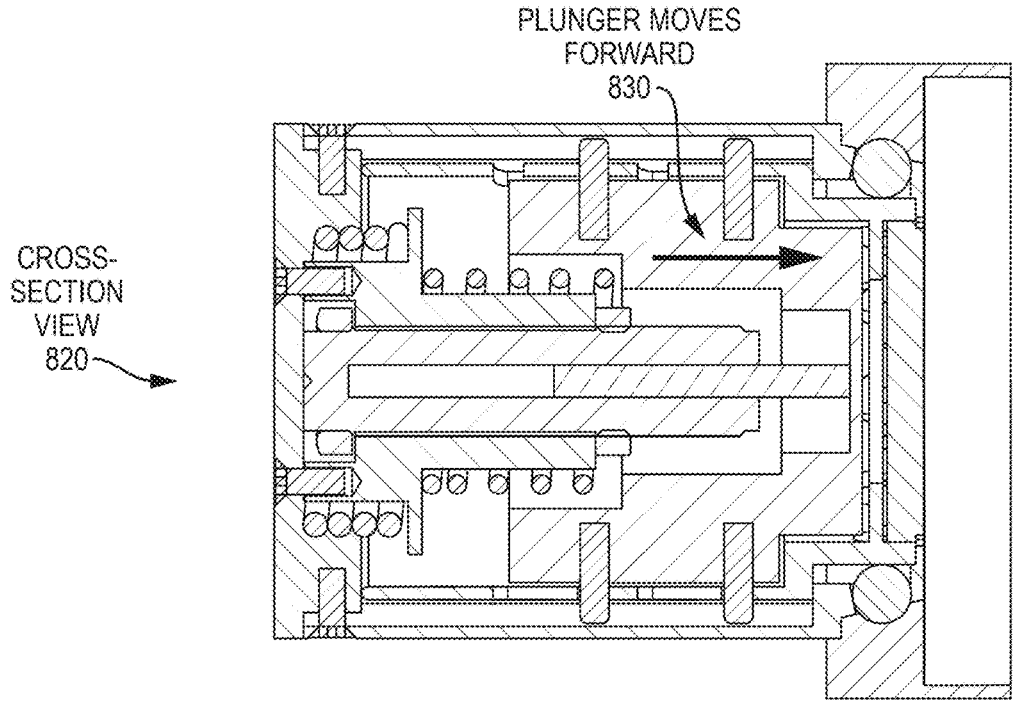

FIGS. 8A and 8B provide an interior view 800 and a cross-section view 820 of the quick disconnect coupler 120 of FIGS. 1A and 1B, at the first deceleration stage 440, configured in accordance with certain embodiments of the present disclosure. As the rocket motor 110 burns out and the platform begins to decelerate, the linear spring 235 and damper 245 are able to push back against the plunger 210 and slide the guide pins 205 forward. Interior view 800 shows the guide pins 205 moving forward 810 through path 310*c* of the guide pin grooves. Cross-section view 820 shows the plunger moving forward 830.

Figure 9A:
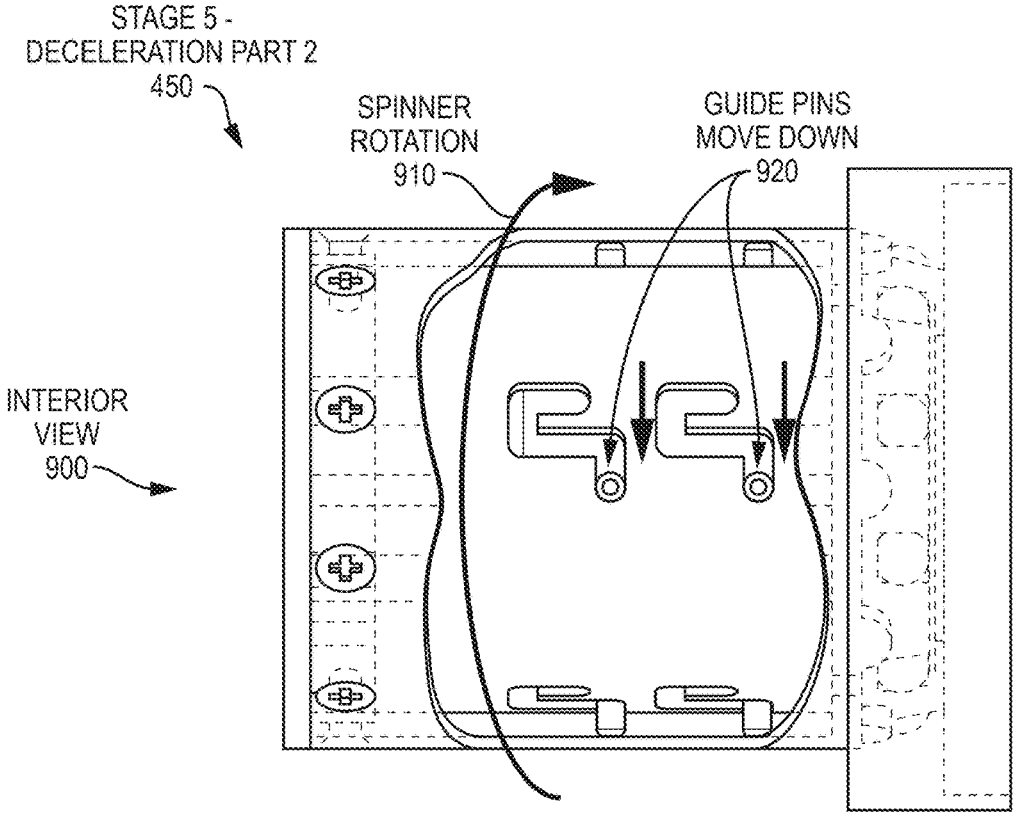
FIGS. 9A and 9B provide an interior and a cross-section view of the quick disconnect coupler of FIGS. 1A and 1B, at a second deceleration stage, configured in accordance with certain embodiments of the present disclosure.
Figure 9B:
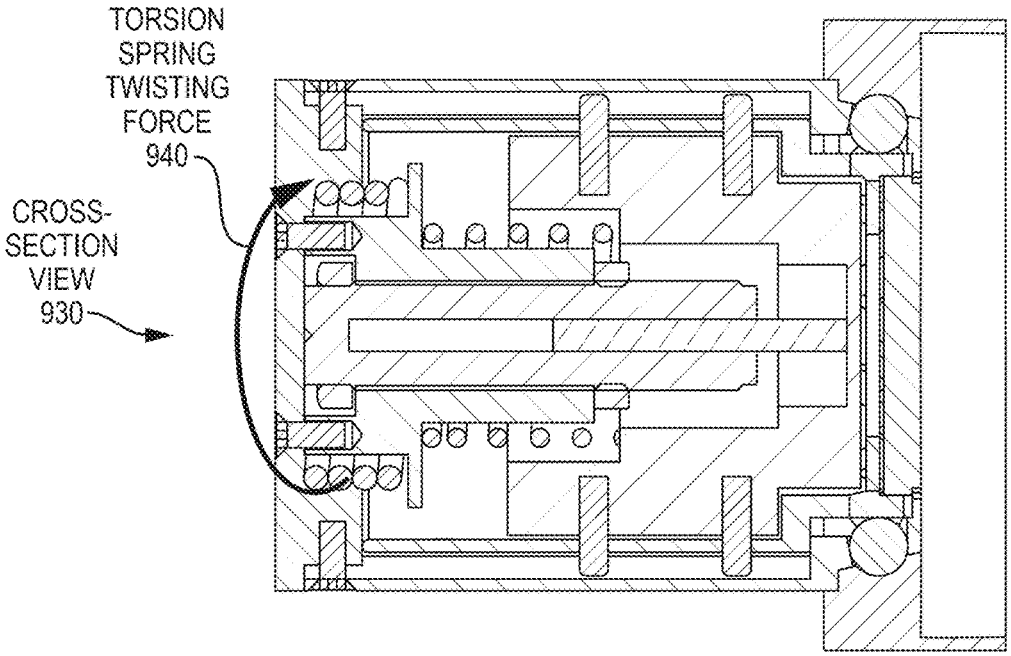

FIGS. 9A and 9B provide an interior view 900 and a cross-section view 930 of the quick disconnect coupler 120 of FIGS. 1A and 1B, at the second deceleration stage 450, configured in accordance with certain embodiments of the present disclosure. As shown in the interior view 900, as the plunger reaches the forward end of the third path 310*c*, the torsion spring 225 is able to rotate 910 the position of the spinner 230 causing the guide pins to move down 920 through path 310*d* of the guide pin grooves. The cross-section view 930 illustrates the torsion spring twisting force 940 which causes the spinner to rotate.

Figure 10A:
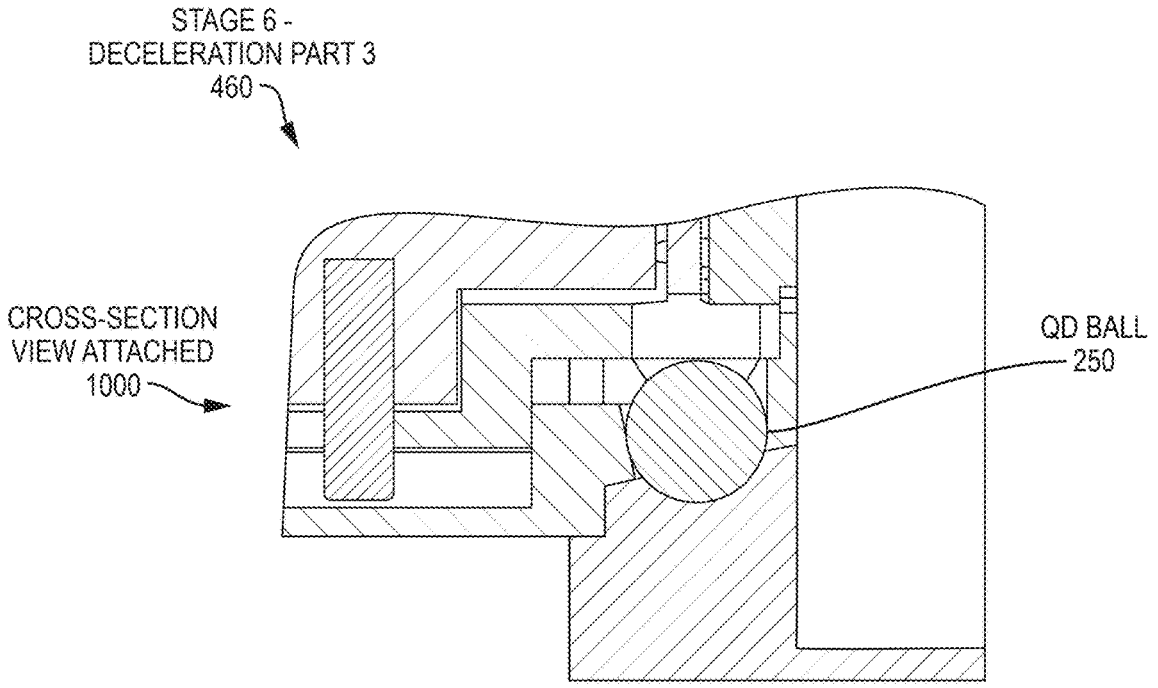
FIGS. 10A and 10B provide cross-section views of operation of the quick disconnect ball of FIG. 2, at a third deceleration stage, in accordance with certain embodiments of the present disclosure.
Figure 10B:
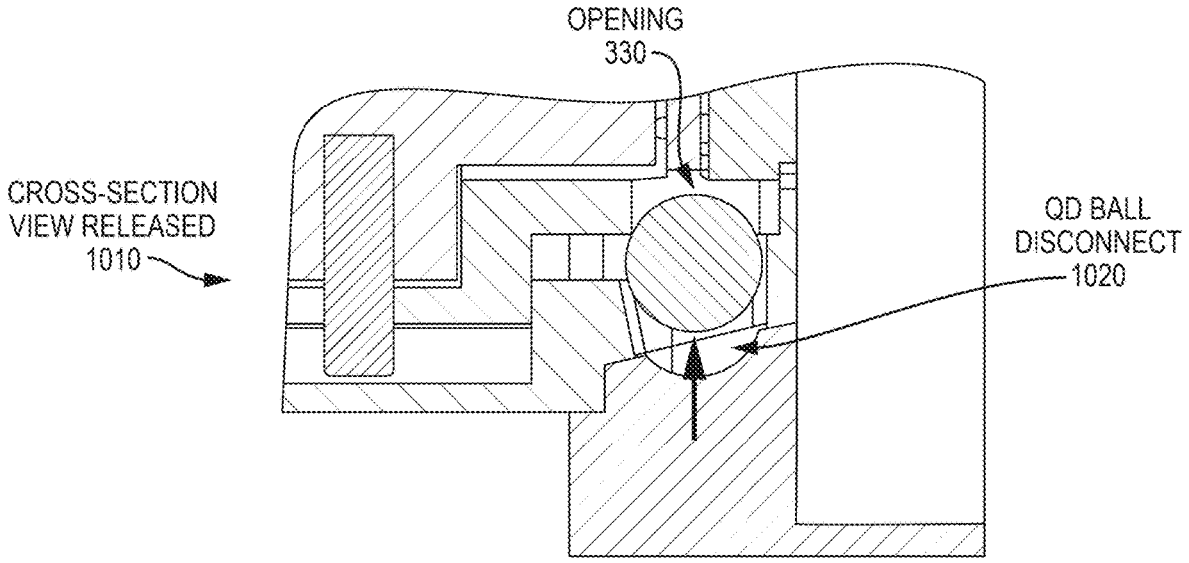

FIGS. 10A and 10B provide cross-section views 1000 and 1010 of operation of the quick disconnect ball 250 of FIG. 2, at the third deceleration stage 460, in accordance with certain embodiments of the present disclosure. After the rocket motor 110 has been spent and the spinner 230 has reached the final point in the groove path 310, an opening 330 is created into which the QD balls 250 can move to release the mechanical attachment of the coupler 120 to the payload section 130. The cross-section view 1000 shows the position of one of the QD balls 250 prior to the creation of the opening 330. In this position the QD ball 250 provides physical mechanical attachment of the coupler to the payload section. Cross-section view 1010 shows the position of the QD ball 250 after the creation of the opening 330 and the movement of the ball into that opening. In this position the QD ball 250 disconnects 1020 from the payload section and the coupler is released.

Figure 11A:
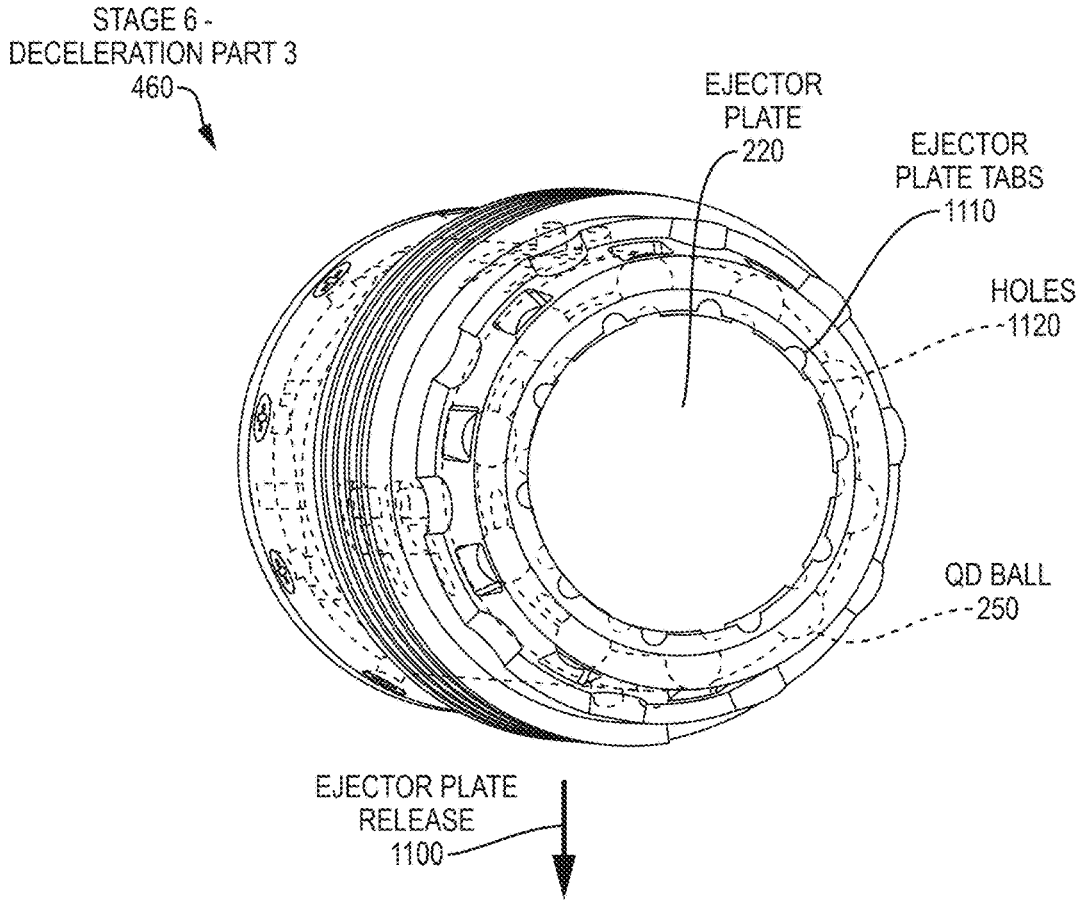
FIGS. 11A and 11B provide perspective views of an ejector plate release, at the third deceleration stage, in accordance with certain embodiments of the present disclosure.
Figure 11B:
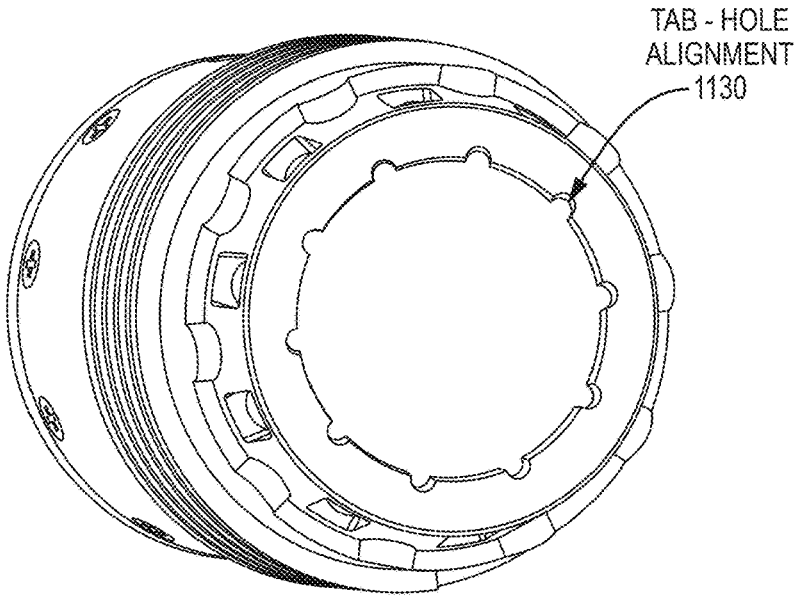

FIGS. 11A and 11B provide perspective views of an ejector plate release 1100, at the third deceleration stage 460, in accordance with certain embodiments of the present disclosure. Simultaneously, or near-simultaneously, with the QD ball disconnection, the ejector plate 220 is released under the force of the wave spring 320. The ejector plate 220 was previously held back by tabs 1110 located around the circumference of the coupler. After the spinner 230 has twisted into the final position, however, the tabs 1110 align with matching holes 1120 in the housing. The tab-hole alignment 1130 allows the ejector plate to release and push the payload 130 away from the coupler 120.

Figure 12:
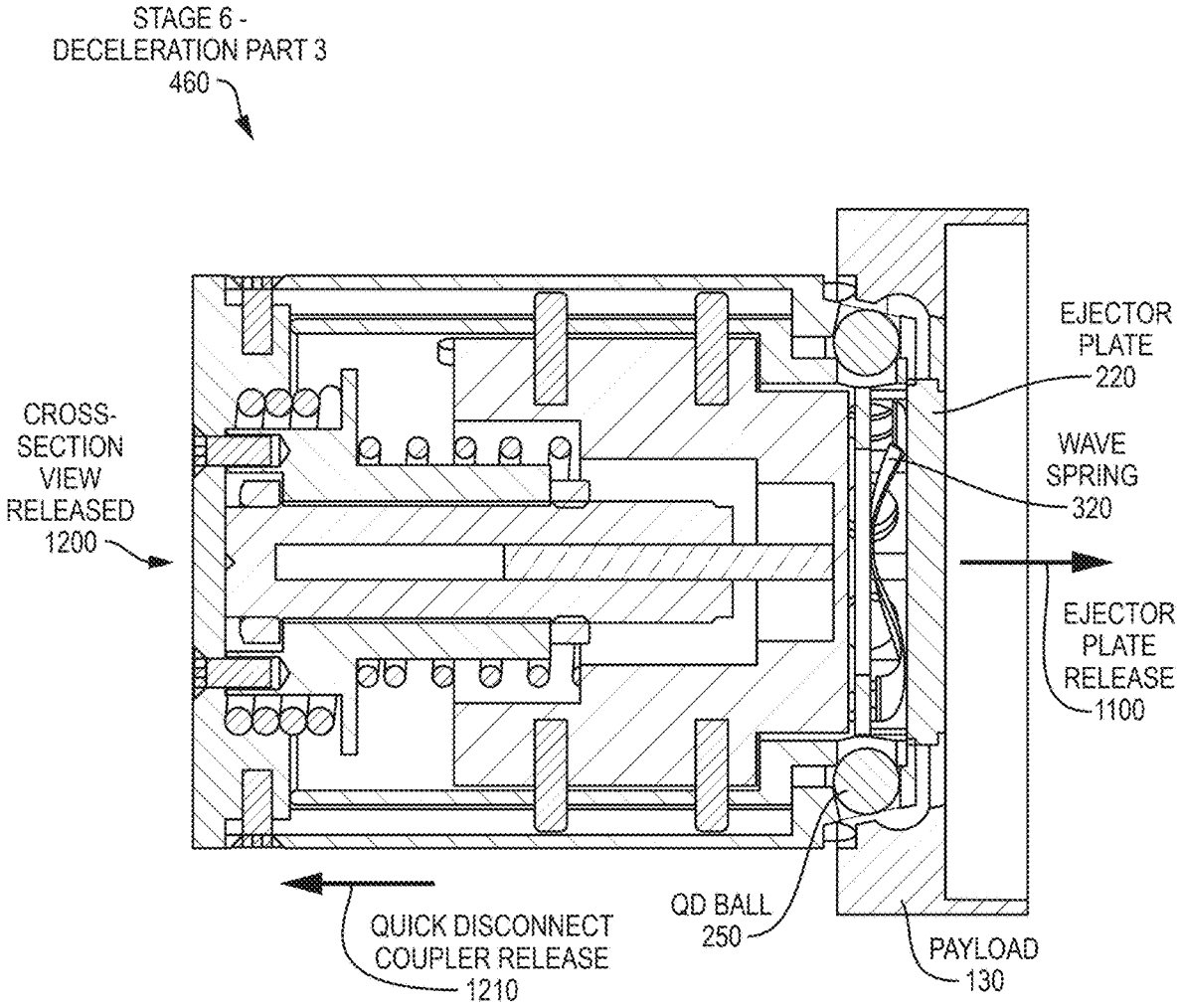
FIG. 12 provides a cross-section view of the quick disconnect coupler release, at the third deceleration stage, in accordance with certain embodiments of the present disclosure.

FIG. 12 provides a cross-section view 1200 of the quick disconnect coupler release 1210 at the third deceleration stage 460, in accordance with certain embodiments of the present disclosure. The cross-section view 1200 provides a summary illustration of the third deceleration stage 460. The QD ball 250 is shown disconnected from the payload 130 and the ejector plate 220 is shown in the released state 1100 under the force of the wave spring 320. The released ejector plate imparts a force on the payload 130 to push apart the payload from the coupler 120 and rocket motor 110.

Methodology

Figure 13:
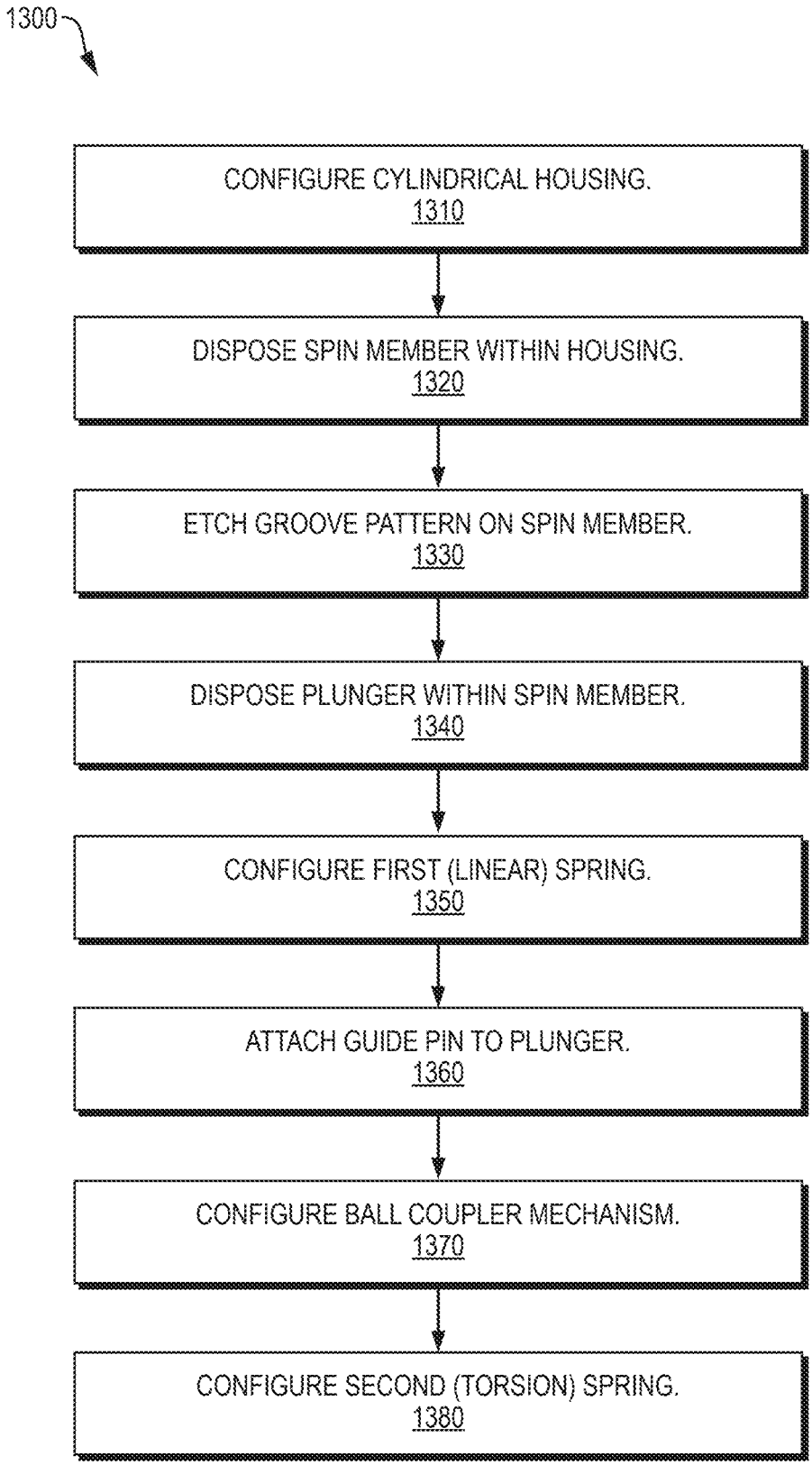
FIG. 13 is a flowchart illustrating a methodology for fabrication of a quick disconnect coupler, in accordance with an embodiment of the present disclosure.

FIG. 13 is a flowchart illustrating a methodology 1300 for fabrication of a quick disconnect coupler, in accordance with an embodiment of the present disclosure. As can be seen, example method 1300 includes a number of phases and sub-processes, the sequence of which may vary from one embodiment to another. However, when considered in aggregate, these phases and sub-processes form a process for fabrication of a quick disconnect coupler 120, in accordance with certain of the embodiments disclosed herein, for example as illustrated in FIGS. 1-2, as described above. However other system architectures can be used in other embodiments, as will be apparent in light of this disclosure. To this end, the correlation of the various functions shown in FIG. 13 to the specific components illustrated in the figures, is not intended to imply any structural and/or use limitations. Rather other embodiments may include, for example, varying degrees of integration wherein multiple functionalities are effectively performed by one system. Numerous variations and alternative configurations will be apparent in light of this disclosure.

In one embodiment, method 1300 commences, at operation 1310, by configuring a cylindrical housing to be fixedly attached to a first section of an aeronautical platform (e.g., the rocket motor). In some embodiments, threading is disposed around the exterior circumference of the housing. The threading is configured to couple to a threaded interface of the first section so that the coupler can be screwed into the first section to be fixedly attached.

At operation 1320, a spin member is disposed within the housing. The spin member is configured to rotate about a longitudinal axis of the platform.

At operation 1330, a groove pattern is etched into the spin member. In some embodiments, the groove pattern comprises: a first path extending in a direction parallel to the longitudinal axis; a second path connecting an aft end of the first path to an aft end of a third path; a third path parallel to the first path; and a fourth path extending from a forward end of the third path in a direction away from the first path.

At operation 1340, a plunger is disposed within the spin member. The plunger is configured to move linearly along the longitudinal axis.

At operation 1350, a first spring (e.g., a linear spring) is configured to cause the linear movement of the plunger in response to acceleration of the platform.

At operation 1360, a guide pin is attached to the plunger such that the guide pin extends radially outward toward the housing. The guide pin is configured to travel along the groove pattern as the plunger moves.

At operation 1370, a ball coupler mechanism is configured to provide mechanical attachment of the coupler system to the second section.

At operation 1380, a second spring (e.g., a torsion spring) is configured to rotate the spin member, such that a combination of the movement of the plunger and the rotation of the spinner cause the ball coupler mechanism to disengage from the second section.

In some embodiments, additional operations may be performed, as previously described in connection with the system. For example, a circular plate is disposed at a forward end of the coupler system and a third spring (e.g., a wave spring) is configured to eject the circular plate, in response to the combination of the movement of the plunger and the rotation of the spinner, such that the second section is ejected from the coupler system.

In some embodiments, the fabrication operations may be performed in different sequences and may include further additional operations. For example, the process may commence by concentrically aligning the plunger and the spinner to form a spinner-plunger assembly. Guide pins are then pressed into the plunger. QD balls are then placed into the housing and the spinner-plunger assembly is inserted into the housing. The springs and the damper are then fastened to the spring post to create a spring post assembly. The uncompressed spring post assembly is then placed into the plunger. The wave spring and ejector are placed into the housing. The springs are then loaded (e.g., compressed) and the assembly is placed into a pre-launch configuration to be joined with the payload. The spring post is then fastened to the housing to fix the configuration so that it can be assembled onto the rocket motor.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical entities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smartphones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood, however, that other embodiments may be practiced without these specific details, or otherwise with a different set of details. It will be further appreciated that the specific structural and functional details disclosed herein are representative of example embodiments and are not necessarily intended to limit the scope of the present disclosure. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

FURTHER EXAMPLE EMBODIMENTS

The following examples pertain to further embodiments, from which numerous permutations and configurations will be apparent.

Example 1 is a coupler system for coupling first and second sections of an aeronautical platform, the coupler system comprising: a cylindrical housing configured to be fixedly attached to the first section; a spin member disposed within the housing and configured to rotate about a longitudinal axis of the platform; a groove pattern etched into the spin member; a plunger disposed within the spin member and configured to move linearly along the longitudinal axis; a first spring configured to cause the linear movement of the plunger in response to acceleration of the platform; a guide pin attached to the plunger, the guide pin extending radially outward toward the housing and configured to travel along the groove pattern as the plunger moves; a ball coupler mechanism configured to provide mechanical attachment of the coupler system to the second section; and a second spring configured to rotate the spin member, such that a combination of the movement of the plunger and the rotation of the spinner cause the ball coupler mechanism to disengage from the second section.

Example 2 includes the system of Example 1, comprising: a circular plate disposed at a forward end of the coupler system, the forward end closest to the second section; and a third spring configured to eject the circular plate, in response to the combination of the movement of the plunger and the rotation of the spinner, such that the second section is ejected from the coupler system.

Example 3 includes the system of Examples 1 or 2, wherein the acceleration of the platform is associated with platform launch forces and the aerodynamic drag forces.

Example 4 includes the system of Example 3, comprising a damper disposed within the plunger and configured to resist linear movement of the plunger in response to forces less than the platform launch forces and aerodynamic drag forces.

Example 5 includes the system of any of Examples 1-4, wherein the groove pattern comprises: a first path extending in a direction parallel to the longitudinal axis; a second path connecting to an aft end of the first path, the aft end closest to the first section; a third path connecting to the second path and extending parallel to the first path; and a fourth path extending from a forward end of the third path in a direction away from the first path, the forward end closest to the second section.

Example 6 includes the system of any of Examples 1-5, wherein the cylindrical housing comprises threading disposed around the exterior circumference of the housing, the threading configured to couple to a threaded interface of the first section to fixedly attach the coupler system to the first section.

Example 7 includes the system of any of Examples 1-6, wherein the first section is a propulsion stage, and the second section is a payload stage.

Example 8 is an aeronautical platform comprising: a first section; a second section; and a coupler section configured to couple the first section to the second section and provide a disconnect capability, the coupler section comprising a cylindrical housing configured to be fixedly attached to the first section, a spin member disposed within the housing and configured to rotate about a longitudinal axis of the platform, a groove pattern etched into the spin member, a plunger disposed within the spin member and configured to move linearly along the longitudinal axis, a first spring configured to cause the linear movement of the plunger in response to acceleration of the platform, a guide pin attached to the plunger, the guide pin extending radially outward toward the housing and configured to travel along the groove pattern as the plunger moves, a ball coupler mechanism configured to provide mechanical attachment of the coupler system to the second section, and a second spring configured to rotate the spin member, such that a combination of the movement of the plunger and the rotation of the spinner cause the ball coupler mechanism to disengage from the second section.

Example 9 includes the aeronautical platform of Example 8, wherein the coupler system comprises: a circular plate disposed at a forward end of the coupler system, the forward end closest to the second section; and a third spring configured to eject the circular plate, in response to the combination of the movement of the plunger and the rotation of the spinner, such that the second section is ejected from the coupler system.

Example 10 includes the aeronautical platform of Examples 8 or 9, wherein the acceleration of the platform is associated with platform launch forces and aerodynamic drag forces.

Example 11 includes the aeronautical platform of Example 10, wherein the coupler system comprises a damper disposed within the plunger and configured to resist linear movement of the plunger in response to forces less than the platform launch forces and the aerodynamic drag forces.

Example 12 includes the aeronautical platform of any of Examples 8-11, wherein the groove pattern comprises: a first path extending in a direction parallel to the longitudinal axis; a second path connecting to an aft end of the first path, the aft end closest to the first section; a third path connecting to the second path and extending parallel to the first path; and a fourth path extending from a forward end of the third path in a direction away from the first path, the forward end closest to the second section.

Example 13 includes the aeronautical platform of any of Examples 8-12, wherein the cylindrical housing comprises threading disposed around the exterior circumference of the housing, the threading configured to couple to a threaded interface of the first section to fixedly attach the coupler system to the first section.

Example 14 includes the aeronautical platform of any of Examples 8-13, wherein the first section is a propulsion stage, and the second section is a payload stage.

Example 15 includes the aeronautical platform of Example 14, wherein the propulsion stage is a rocket motor.

Example 16 includes the aeronautical platform of Example 14, wherein the payload stage comprises one or more of a guidance module, a seeker module, and a warhead.

Example 17 is a method for fabricating a coupler system, the method comprising: configuring a cylindrical housing to be fixedly attached to a first section of an aeronautical platform; disposing a spin member within the housing, the spin member configured to rotate about a longitudinal axis of the platform; etching a groove pattern into the spin member; disposing a plunger within the spin member, the plunger configured to move linearly along the longitudinal axis; configuring a first spring to cause the linear movement of the plunger in response to acceleration of the platform; attaching a guide pin to the plunger, the guide pin extending radially outward toward the housing and configured to travel along the groove pattern as the plunger moves; configuring a ball coupler mechanism to provide mechanical attachment of the coupler system to a second section of the aeronautical platform; and configuring a second spring to rotate the spin member, such that a combination of the movement of the plunger and the rotation of the spinner cause the ball coupler mechanism to disengage from the second section.

Example 18 includes the method of Example 17, comprising: disposing a circular plate at a forward end of the coupler system, the forward end closest to the second section; and configuring a third spring to eject the circular plate, in response to the combination of the movement of the plunger and the rotation of the spinner, such that the second section is ejected from the coupler system.

Example 19 includes the method of Examples 17 or 18, wherein the groove pattern comprises: a first path extending in a direction parallel to the longitudinal axis; a second path connecting to an aft end of the first path, the aft end closest to the first section; a third path connecting to the second path and extending parallel to the first path; and a fourth path extending from a forward end of the third path in a direction away from the first path, the forward end closest to the second section.

Example 20 includes the method of any of Examples 17-19, comprising disposing threading around the exterior circumference of the housing, the threading configured to couple to a threaded interface of the first section to fixedly attach the coupler system to the first section.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be appreciated in light of this disclosure. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner and may generally include any set of one or more elements as variously disclosed or otherwise demonstrated herein.

What is claimed is:

1. A coupler system for coupling first and second sections of an aeronautical platform, the coupler system comprising:

a cylindrical housing configured to be fixedly attached to the first section;

a spin member disposed within the housing and configured to rotate about a longitudinal axis of the platform;

a groove pattern etched into the spin member;

a plunger disposed within the spin member and configured to move linearly along the longitudinal axis;

a first spring configured to cause the linear movement of the plunger in response to acceleration of the platform;

a guide pin attached to the plunger, the guide pin extending radially outward toward the housing and configured to travel along the groove pattern as the plunger moves;

a ball coupler mechanism configured to provide mechanical attachment of the coupler system to the second section; and a second spring configured to rotate the spin member, such that a combination of the movement of the plunger and the rotation of the spinner cause the ball coupler mechanism to disengage from the second section.

2. The coupler system of claim 1, comprising:

a circular plate disposed at a forward end of the coupler system, the forward end closest to the second section; and a third spring configured to eject the circular plate, in response to the combination of the movement of the plunger and the rotation of the spinner, such that the second section is ejected from the coupler system.

3. The coupler system of claim 1, wherein the acceleration of the platform is associated with platform launch forces and the aerodynamic drag forces.

4. The coupler system of claim 3, comprising a damper disposed within the plunger and configured to resist linear movement of the plunger in response to forces less than the platform launch forces and aerodynamic drag forces.

5. The coupler system of claim 1, wherein the groove pattern comprises:

a first path extending in a direction parallel to the longitudinal axis;

a second path connecting to an aft end of the first path, the aft end closest to the first section;

a third path connecting to the second path and extending parallel to the first path; and a fourth path extending from a forward end of the third path in a direction away from the first path, the forward end closest to the second section.

6. The coupler system of claim 1, wherein the cylindrical housing comprises threading disposed around the exterior circumference of the housing, the threading configured to couple to a threaded interface of the first section to fixedly attach the coupler system to the first section.

7. The coupler system of claim 1, wherein the first section is a propulsion stage, and the second section is a payload stage.

8. An aeronautical platform comprising:

a first section;

a second section; and a coupler section configured to couple the first section to the second section and provide a disconnect capability, the coupler section comprising a cylindrical housing configured to be fixedly attached to the first section, a spin member disposed within the housing and configured to rotate about a longitudinal axis of the platform, a groove pattern etched into the spin member, a plunger disposed within the spin member and configured to move linearly along the longitudinal axis, a first spring configured to cause the linear movement of the plunger in response to acceleration of the platform, a guide pin attached to the plunger, the guide pin extending radially outward toward the housing and configured to travel along the groove pattern as the plunger moves, a ball coupler mechanism configured to provide mechanical attachment of the coupler system to the second section, and a second spring configured to rotate the spin member, such that a combination of the movement of the plunger and the rotation of the spinner cause the ball coupler mechanism to disengage from the second section.

9. The aeronautical platform of claim 8, wherein the coupler system comprises:

a circular plate disposed at a forward end of the coupler system, the forward end closest to the second section; and a third spring configured to eject the circular plate, in response to the combination of the movement of the plunger and the rotation of the spinner, such that the second section is ejected from the coupler system.

10. The aeronautical platform of claim 8, wherein the acceleration of the platform is associated with platform launch forces and aerodynamic drag forces.

11. The aeronautical platform of claim 10, wherein the coupler system comprises a damper disposed within the plunger and configured to resist linear movement of the plunger in response to forces less than the platform launch forces and the aerodynamic drag forces.

12. The aeronautical platform of claim 8, wherein the groove pattern comprises:

a first path extending in a direction parallel to the longitudinal axis;

a second path connecting to an aft end of the first path, the aft end closest to the first section;

a third path connecting to the second path and extending parallel to the first path; and a fourth path extending from a forward end of the third path in a direction away from the first path, the forward end closest to the second section.

13. The aeronautical platform of claim 8, wherein the cylindrical housing comprises threading disposed around the exterior circumference of the housing, the threading configured to couple to a threaded interface of the first section to fixedly attach the coupler system to the first section.

14. The aeronautical platform of claim 8, wherein the first section is a propulsion stage, and the second section is a payload stage.

15. The aeronautical platform of claim 14, wherein the propulsion stage is a rocket motor.

16. The aeronautical platform of claim 14, wherein the payload stage comprises one or more of a guidance module, a seeker module, and a warhead.

17. A method for fabricating a coupler system, the method comprising:

configuring a cylindrical housing to be fixedly attached to a first section of an aeronautical platform;

disposing a spin member within the housing, the spin member configured to rotate about a longitudinal axis of the platform;

etching a groove pattern into the spin member;

disposing a plunger within the spin member, the plunger configured to move linearly along the longitudinal axis;

configuring a first spring to cause the linear movement of the plunger in response to acceleration of the platform;

attaching a guide pin to the plunger, the guide pin extending radially outward toward the housing and configured to travel along the groove pattern as the plunger moves;

configuring a ball coupler mechanism to provide mechanical attachment of the coupler system to a second section of the aeronautical platform; and configuring a second spring to rotate the spin member, such that a combination of the movement of the plunger and the rotation of the spinner cause the ball coupler mechanism to disengage from the second section.

18. The method of claim 17, comprising:

disposing a circular plate at a forward end of the coupler system, the forward end closest to the second section; and configuring a third spring to eject the circular plate, in response to the combination of the movement of the plunger and the rotation of the spinner, such that the second section is ejected from the coupler system.

19. The method of claim 17, wherein the groove pattern comprises:

a first path extending in a direction parallel to the longitudinal axis;

a second path connecting to an aft end of the first path, the aft end closest to the first section;

a third path connecting to the second path and extending parallel to the first path; and a fourth path extending from a forward end of the third path in a direction away from the first path, the forward end closest to the second section.

20. The method of claim 17, comprising disposing threading around the exterior circumference of the housing, the threading configured to couple to a threaded interface of the first section to fixedly attach the coupler system to the first section.

* * * * *